US011994009B2

(12) United States Patent
Alnoaimi et al.

(10) Patent No.: US 11,994,009 B2
(45) Date of Patent: May 28, 2024

(54) NON-EXPLOSIVE $CO_2$-BASED PERFORATION TOOL FOR OIL AND GAS DOWNHOLE OPERATIONS

(71) Applicant: SAUDI ARABIAN OIL COMPANY, Dhahran (SA)

(72) Inventors: Khalid R. Alnoaimi, Khobar (SA); Khalid M. Alruwaili, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/835,477

(22) Filed: Mar. 31, 2020

(65) Prior Publication Data

US 2021/0301633 A1 Sep. 30, 2021

(51) Int. Cl.
*E21B 43/119* (2006.01)
*E21B 43/263* (2006.01)

(52) U.S. Cl.
CPC ..... *E21B 43/119* (2013.01); *E21B 43/263* (2013.01)

(58) Field of Classification Search
CPC .... E21B 43/119; E21B 43/263; E21B 43/116; E21B 43/117
See application file for complete search history.

(56) References Cited

U.S. PATENT DOCUMENTS 2,609,751 A 9/1952 Taylor et al.
2,732,800 A * 1/1956 Coursen ..... F42B 3/06 102/326
3,175,613 A * 3/1965 Parker ..... E21B 43/114 166/300
4,272,128 A 6/1981 Jacoby
4,458,945 A 7/1984 Ayler et al.
7,367,631 B2 5/2008 Van Dyk
8,684,083 B2 4/2014 Torres et al.
8,701,794 B2 4/2014 Zediker et al.
(Continued)

FOREIGN PATENT DOCUMENTS

CN 104632221 A 5/2015
CN 106223919 * 12/2016 ..... E21B 43/26
(Continued)

OTHER PUBLICATIONS

International Search Report issued in corresponding International Application No. PCT/US2020/031800, dated Dec. 22, 2020 (4 pages).
(Continued)

*Primary Examiner* — Blake Michener
*Assistant Examiner* — Yanick A Akaragwe
(74) *Attorney, Agent, or Firm* — Osha Bergman Watanabe & Burton LLP

(57) ABSTRACT

Methods and systems for perforating a downhole formation which include attaching a $CO_2$ perforating device to a wireline, where the $CO_2$ perforating device may include one or more $CO_2$ filled perforating units. The methods and systems may further include disposing the $CO_2$ perforating device at a depth within a wellbore and detonating the one or more $CO_2$ filled perforating units to perforate one or more surfaces selected from the group consisting of the wellbore casing, cement, and the downhole formation.

20 Claims, 3 Drawing Sheets

(56) References Cited

U.S. PATENT DOCUMENTS

| | | | | |
|---|---|---|---|---|
| 8,807,003 | B2 | 8/2014 | Le et al. | |
| 9,416,610 | B2 | 8/2016 | Dotson | |
| 10,174,594 | B2 | 1/2019 | Dotson et al. | |
| 10,450,839 | B2 * | 10/2019 | Bulekbay | E21B 43/16 |
| 2002/0007949 | A1 * | 1/2002 | Tolman | E21B 33/138 166/308.1 |
| 2002/0023751 | A1 * | 2/2002 | Neuroth | E21B 23/14 166/302 |
| 2005/0178554 | A1 * | 8/2005 | Hromas | E21B 43/14 166/313 |
| 2010/0258292 | A1 * | 10/2010 | Tiernan | E21B 43/117 166/63 |
| 2015/0096752 | A1 * | 4/2015 | Burgos | E21B 43/1185 166/297 |
| 2015/0240607 | A1 * | 8/2015 | Hales | E21B 43/117 175/3.5 |
| 2016/0145989 | A1 * | 5/2016 | Ferguson | E21B 33/138 166/281 |
| 2017/0114624 | A1 * | 4/2017 | Ely | E21B 33/13 |
| 2017/0175500 | A1 * | 6/2017 | Robey | E21B 43/117 |
| 2017/0234116 | A1 * | 8/2017 | Gilliat | E21B 43/117 166/297 |
| 2018/0340390 | A1 | 11/2018 | Oag et al. | |
| 2019/0063214 | A1 * | 2/2019 | Castillo | E21B 47/024 |
| 2019/0284889 | A1 * | 9/2019 | Lagrange | E21B 47/092 |
| 2021/0277724 | A1 * | 9/2021 | Harrigan | E21B 43/117 |

FOREIGN PATENT DOCUMENTS

| | | | |
|---|---|---|---|
| CN | 106223919 | A | 12/2016 |
| CN | 106917613 | A | 7/2017 |
| CN | 107420077 | A | 12/2017 |
| CN | 109098695 | A | 12/2018 |
| GB | 654958 | A | 7/1951 |
| RU | 2677524 | C1 | 1/2019 |

OTHER PUBLICATIONS

Written Opinion issued in corresponding International Application No. PCT/US2020/031800, dated Dec. 22, 2020 (8 pages).

Gao, Feng et al., "Mechanism Analysis of Liquid Carbon Dioxide Phase Transition for Fracturing Rock Masses", Energies, MDPI, Oct. 23, 2018, URL: https://doi.org/10.3390/en11112909 (12 pages).

Kang, Jianhong et al, "Evaluation of gas drainage and coal permeability improvement with liquid CO2 gasification blasting", Advances in Mechanical Engineering, vol. 10(4), Apr. 6, 2018, URL: https://doi.org/10.1177%2F1687814018768578 (15 pages).

Parsakhoo, Aidin and Majid Lotfalian, "Demolition Agent Selection for Rock Breaking in Mountain Region of Hyrcanian Forests", Research Journal of Environmental Sciences, Academic Journals Inc., vol. 3(3), 2009, pp. 384-391 (9 bages).

"Cardox CO2 Blaster: Carbon Dioxide Blaster", Pneumat Systems Inc., Product Brochure, URL: https://pneumat.com/products/cardox-co2-blaster/# (4 pages).

"How the Cardox CO2 System works", Cardox International Limited, Cardox Global Services PTE, Ltd. & Cardox Global Resources PTE, Ltd., Accessed Mar. 30, 2020, URL: https://www.cardox.net/cardox/how_cardox_works.html.

"Cardox: Australian Distributor for ATD Cardox Pressurised CO2 blasting systems", Absafe Specialist Access and Remedial Engineering, Accessed Mar. 30, 2020, URL: https://www.absafe.com.au/cardox.html.

"Non-Explosives: Solution for Rock & Concrete Breaking", Cardox Systems, Cardox Global Services PTE Ltd, URL: https://www.cardox.net/cardox/Civils_hi_res.pdf (4 pages).

Huang, Man et al., "Effects of Configuration on Rock Erosion Under a Supercritical Carbon Dioxide Jet at Various Pressures and Temperatures", Ed. Jose Augusto Paixao Coelho, Applied Sciences, MDPI, Jun. 12, 2017 (21 pages).

Zhang, Yanan et al., "Experimental Study on Explosion Pressure and Rock Breaking Characteristics under Liquid Carbon Dioxide Blasting", Advances in Civil Engineering, Hindawi, vol. 2018, Article ID 7840125, Aug. 27, 2018, URL: https://doi.org/10.1155/2018/7840125 (10 pages).

* cited by examiner

NON-EXPLOSIVE $CO_2$-BASED PERFORATION TOOL FOR OIL AND GAS DOWNHOLE OPERATIONS

BACKGROUND

In order to produce hydrocarbon fluids from subterranean formations, a borehole is drilled from the surface down into the desired formations. Subsequently, a casing is commonly provided in the borehole, thereby defining a hollow wellbore. In order for the hydrocarbon fluids to flow from the surrounding formations into the wellbore and up to the surface, it is necessary to perforate the casing. Perforating and fracturing a well is common practice in the oil and gas industry in an effort to stimulate the well and increase the production of hydrocarbons. This is typically done using a perforating gun, a downhole tool that detonates explosive charges at selected locations in order to form holes in the casing.

Perforation is an important completion stage technique used in cased-holes to establish downhole connectivity between the reservoir and the wellbore. Commonly, lateral holes (perforations) are shot through the casing and/or cement and/or formation surrounding the casing to allow hydrocarbon flow into the wellbore and, if necessary, to allow treatment fluids to flow from the wellbore into the formation.

During perforation, a tunnel is created from the casing or liner into the reservoir formation, through which oil or gas is produced. The most common methods employ jet perforating guns equipped with shaped explosive charges. As such, most of the commonly used perforators today are based on explosive content that requires special permits to use, cause environmental damage and may impose safety risks to nearby workers. However, other perforating methods include bullet perforating, abrasive jetting or high-pressure fluid jetting. The perforation and fracturing of a well can be rather time consuming and, thus, expensive to perform.

Conventional equipment, as described above, that is used to perforate and isolate a zone of interest of the well often do not allow multiple zones of the well to be stimulated at once. For example, a perforation gun is commonly employed to perforate the well casing and the rock formation such that the perforations in the formation may then be fractured. Perforation guns generally consist of a series of charges dispersed at various heights and angular orientations along a cylinder. After the perforation gun has been loaded with charges, it is run into the hole and positioned within a zone of interest. The charges are then set off causing multiple perforations through well casing and into the formation. However to perforate another zone of the well, the perforation gun must typically be removed from the well and loaded with new charges. This process limits the number of zones that can be perforated and then fractured in a single day.

Demolition agents have commonly been used in rock fracturing endeavors and their specific selection is directly dependent upon the target impacted material and the specific requisites of the project. Errors and problem arise in circumstances where incorrect or improper demolition agents are employed.

As a consequence of these issues, the operation at the well site may have to wait for the permission to be received. This can lead to delayed scheduling of critical/time-dependent oil and gas operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to methods for perforating a downhole formation that may include attaching a $CO_2$ perforating device to a wireline, where the $CO_2$ perforating device may include one or more $CO_2$ filled perforating units. The process may further include disposing the $CO_2$ perforating device at a depth within a wellbore and detonating the one or more $CO_2$ filled perforating units to perforate one or more surfaces selected from the group consisting of the wellbore casing, cement, and the downhole formation.

In a further aspect, embodiments disclosed herein relate to methods for perforating a downhole formation that may include disposing a well tool in a wellbore, the well tool comprising one or more vessels filled with carbon dioxide liquid. The methods may also include rapidly heating the carbon dioxide liquid via an electrical charge to form high pressure carbon dioxide and then discharging the high pressure carbon dioxide via one or more directional outlets associated with each vessel to perforate the downhole formation.

In another aspect, embodiments disclosed herein relate to systems for perforating a downhole formation that may include a well tool disposed on a wireline. The systems may include a well tool that may further include one or more vessels filled with carbon dioxide liquid, one or more directional outlets associated with each vessel, an electrical charge generation device configured to rapidly heat the carbon dioxide liquid to form a high pressure carbon dioxide, a pressure relief device configured to discharge the high pressure carbon dioxide through the one or more directional outlets, and an actuation mechanism configured to activate the electrical charge generation device.

Other aspects and advantages of the claimed subject matter will be apparent from the following description and the appended claims.

BRIEF DESCRIPTION OF DRAWINGS

FIG. 1A shows a modified perforation device and FIGS. 1B and 1C show $CO_2$ filled perforating devices according to the present disclosure.

DETAILED DESCRIPTION

Figure 1A:
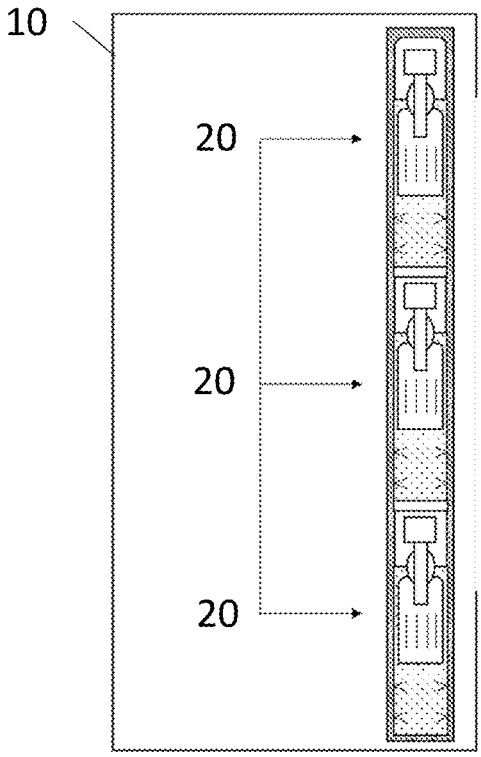
FIGS. 1A-1B are schematic illustrations of examples of perforation devices according to the present disclosure.

Embodiments in accordance with the present disclosure generally relate to methods and systems for perforating a downhole formation with a nonexplosive perforating device. Such methods and systems may provide a critical role in establishing initial hydraulic contact between the rock formation and the wellbore. The perforating device may include at least one nonexplosive perforating charge that can be remotely detonated to perforate the wellbore (cased or uncased) and allow the formation fluids to enter the wellbore.

As described above, perforation is an important completion stage technique used in cased-holes to establish downhole connectivity between the reservoir and the wellbore. Embodiments in accordance with the present disclosure generally relate to methods and systems for perforating a downhole formation. Such methods, according to one or more embodiments, may include attaching one or more $CO_2$ filled perforating devices to a wireline and placing the devices in a wellbore where they may be detonated to perforate one or more of the wellbore casing, cement, and downhole formation.

One or more embodiments of the present disclosure relate to non-explosive techniques for perforating a downhole formation. By employing a non-explosive technique for perforating a downhole formation, certain time consuming steps regarding regulated measures relating to government approval for the transport and use of explosives may be bypassed. Specifically, this may reduce lead time for operations at the well site that may be delayed by such regulatory measures. Embodiments herein may also reduce associated risks that arise with the use of explosive devices.

Additionally, explosive based techniques of the prior art require secure storage and must be well maintained to delay material expiration. In contrast, the well tool of the present application requires no special storage, as it primarily only requires storing $CO_2$ liquid, which has no expiration date. The use of a well tool, in accordance with one or more embodiments of the present disclosure, in a non-explosive perforation method requires no special transport, use, or import permissions from the government. This will aid in executing scheduled operations as planned. The methods and systems of the present disclosure also provide an environmentally friendly and safe-to-use option for on-site personnel.

For the purpose of the present disclosure, numerous components and conditions are customarily employed and well known to those of ordinary skill in the art of well production stimulation. Such accompanying components may not be shown or discussed herein.

One or more embodiments of the present disclosure relates to a well tool for perforating a formation. In one or more embodiments, the well tool may include one or more vessels filled with carbon dioxide liquid. The well tool may include a directional outlet, or discharge outlet associated with each vessel, as well as an electrical charge generation device, or electric charge source, configured to initiate heating of the carbon dioxide liquid to form a high pressure carbon dioxide gas or supercritical fluid. The well tool may further include a pressure relief device, such as a rupture disc, configured to discharge the high pressure carbon dioxide through the directional outlet. The well tool may also include an actuation mechanism configured to activate the electrical charge generation device. Further, embodiments herein may include a stabilization mechanism to position and stabilize the well tool in a wellbore.

The $CO_2$ filled perforating devices according to embodiments herein may only require milliseconds to complete the perforation operation, once emplaced in the wellbore. In comparison, conventional non-explosive jetting-based perforation methods may take several minutes to complete the perforation operation. This provides an additional advantage over existing non-explosive perforation techniques.

Figure 1B:
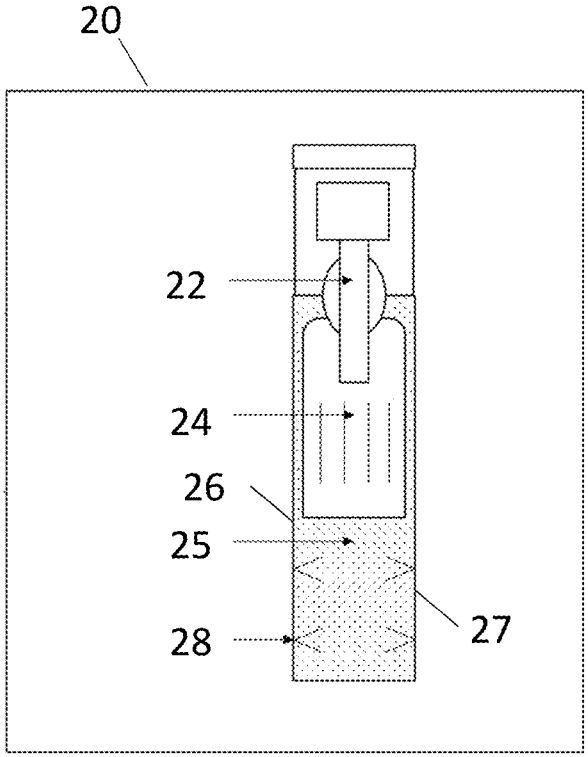
Figure 1C:
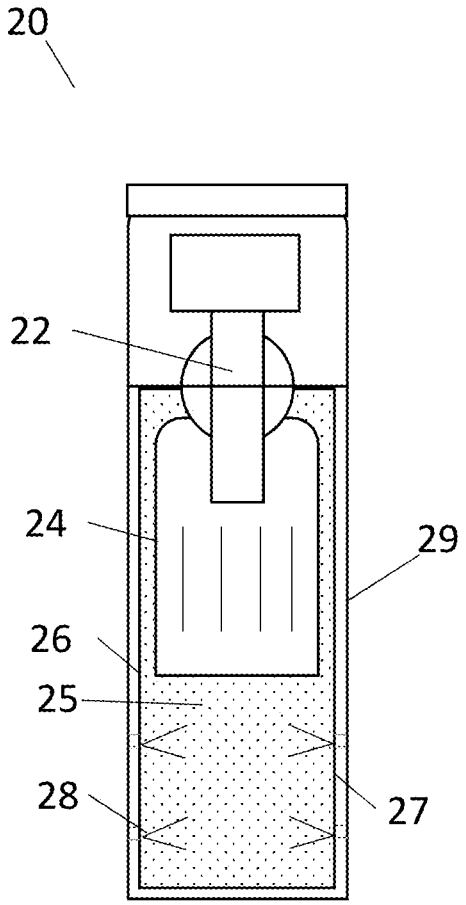

As illustrated in FIGS. 1A and 1B, a well tool perforating device 10 for perforating a downhole formation according to embodiments herein may include one or more $CO_2$ filled $CO_2$ filled perforating devices 20, which may be connected in series and/or parallel (series configuration illustrated). The $CO_2$ filled perforating devices 20 may include an electrical charge source 22, a heating source 24, liquid $CO_2$ 25 contained within a tube body 26. The tube body 26 may also include a discharge head 27, which may include one or more rupture discs (not shown) and one or more discharge outlets 28 for discharging the heated and pressurized $CO_2$ gas. The one or more discharge outlets 28 may be oriented circumferentially around discharge head 27, as shown in FIG. 1. During operation of the perforation device, and as detailed below, the perforation device may be positioned within a downhole formation, such as in an open or cased wellbore. The device may be configured to perforate such a downhole formation by dispelling the heated $CO_2$ as a directionally controlled high pressure gas stream through the one or more discharge heads.

One or more embodiments of the present disclosure may include a well tool for perforating a formation, where the well tool may be a $CO_2$ filled perforating device as described above and illustrated in FIGS. 1 and 1A. In such a system, $CO_2$ in a liquid phase 25 is contained within the vessel/tube body 26. The perforating device may be disposed within a wellbore at a desired location, after which the $CO_2$ may be rapidly heated via heat generated by the heating source 24. Heating source 24 may be, for example, actuated by an electric charge initiated from a firing head or other electrical charge generating sources 22. The original volume of liquid $CO_2$ may be heated by heating source 24 to result in a rapid expansion of its initial volume in the course of milliseconds. Such rapid heating and expansion over such a short period of time serves to produce a large pulse and pressure wave that bursts a rupture disc (not shown) directionally discharging the pressurized $CO_2$ through the discharge outlets 28. An initial pressure of the ejected gas may be in the range from 30,000, 32,000, or 34,000 psia to 36,000, 38,000, or 40,000 psia depending on the rupture disc setting, volume of liquid $CO_2$ stored in the vessel 26, and the amount of heating supplied by the heating element 24. Such pressure is high enough to break materials, such as rock, some pipes, and other materials as may be found downhole, and in accordance with one or more embodiments herein, may be used for perforating wellbores.

Figure 2:
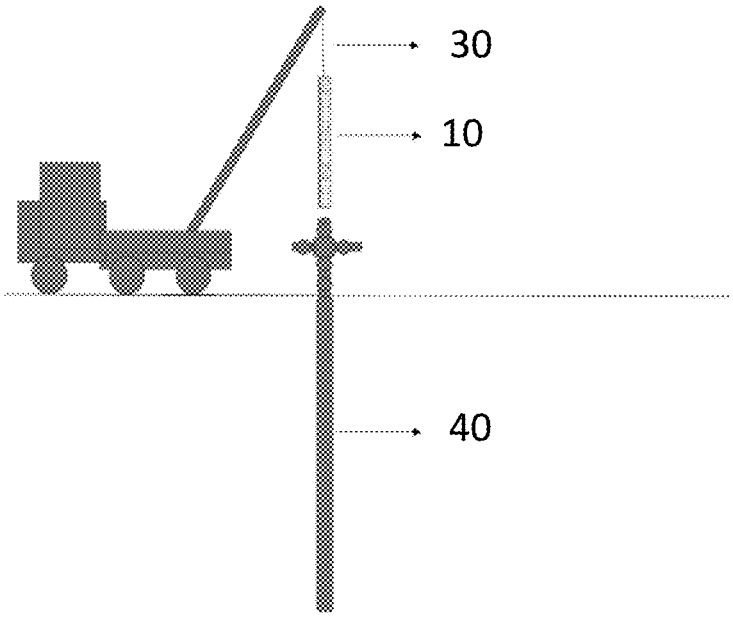
FIG. 2 is a schematic illustration of placing a perforation device in a wellbore according to the present disclosure.

In one or more embodiments, the methods and systems herein may include disposing a well tool 10 on a wireline 30, as shown in FIG. 2, where the well tool may include one or more $CO_2$ filled perforating devices 20 disposed in series and/or parallel. In a series configuration, as illustrated, the bottom of a first $CO_2$ filled perforating device 20 may be disposed above the top of a second $CO_2$ filled perforating device 20. Such an embodiment is demonstrated in FIG. 1A and FIG. 2, where multiple $CO_2$ filled perforating devices 20 are positioned on top of each other. Such a configuration may allow the non-explosive perforating devices according to embodiments herein to function similar to conventional explosive-based perforators, such as shaped charges. Such a design may allow for the high pressure carbon dioxide streams generated by the tool to perforate through the casing, cement, and/or rock formation at differing depth positions in the wellbore. In one or more embodiments, a depth may be defined as a distance through the wellbore relative to a top of the wellbore, as may be understood to those skilled in the art to apply to both vertical and horizontal wells In other embodiments, multiple $CO_2$ filled perforating devices may be connected via wireline, such that a section of wireline is provided between two or more $CO_2$ filled perforating devices. This may allow for a single wireline operation to be used for perforating at multiple depths.

Unlike explosive perforators, $CO_2$ filled perforating devices according to embodiments herein create the perforations through physical expansion due to a phase change induced by rapid electric charge heating, creating a "detonation." This electric charge detonation may be controllably triggered to occur in every $CO_2$ filled perforating device 20 unit simultaneously, or they may be triggered in a time series of detonations.

In some embodiments, where two or more $CO_2$ filled perforating devices 20 are employed, such as depicted in FIG. 1A, the two or more $CO_2$ filled perforating devices 20 may be configured to discharge high pressure $CO_2$ at different pressures. For example, the rupture disc of one $CO_2$ filled perforating devices 20 may be different from the rupture disc of a second or third $CO_2$ filled perforating devices 20 to provide for differing levels of high pressure $CO_2$ gas discharge. Such may be useful, for example, where a section of uncased wellbore is perforated below a section of cased wellbore, or for where the perforation devices are disposed within rock formations of differing structure.

In one or more embodiments, the expanded $CO_2$ will act as a sharp jet or stream of gas that is strong enough to create holes and penetrate one or more of the casing, cement, and formation in cased-hole completions. Such a device may also be used for open-hole completion. As shown in FIG. 1, four discharge heads or rupture discs may be positioned along the body section of the $CO_2$ filled perforating unit that may be capable of producing perforations in the surrounding wellbore casing, cement and/or formation. In some embodiments, there may be no casing or cement to penetrate, allowing the produced gas jet stream discharge to perforate deeper into the formation. In certain embodiments, the total number of perforations created may be equal to the number of perforator discharge outlets designed per unit multiplied by the number of units. While the $CO_2$ filled perforating devices 20 in FIGS. 1A and 1B are illustrated as having four discharge outlets 28 each, any number of outlets may be used, such as from 1 to 12. The number of outlets may depend upon the volume of $CO_2$ stored in vessel 26, the amount of heating that may be supplied by the heating element 24, as well as the desired pressure and flow rate desired for the initial discharge.

In one or more embodiments, the perforating tool may include between 1 and 5 $CO_2$ filled perforating devices, where each $CO_2$ filled perforating device may include multiple discharge heads (ruptured discs). FIG. 1 illustrates a perforating tool including three $CO_2$ filled perforating devices as described in accordance with one or more embodiments of the present disclosure, and thus may result in twelve perforations.

Figure 3:
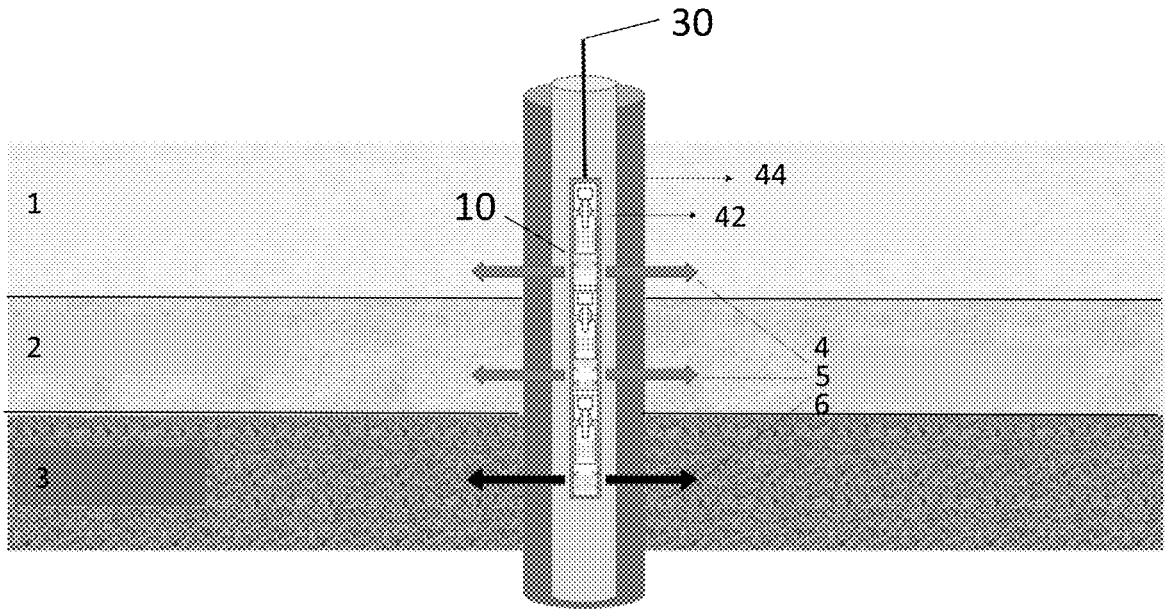
FIG. 3 is a schematic illustration of perforating one or more of a casing, cement and formation with a perforation device according to the present disclosure.

In one or more embodiments, the $CO_2$ filled perforating device may be configured alone, in parallel, or in series, and in configurations having more than one $CO_2$ filled perforating devices, each $CO_2$ filled perforating device 20 may be detonated simultaneously or individually. In one or more embodiments, the $CO_2$ filled perforating device units may be controllably detonated independent of each other, when the modified perforation device includes more than one $CO_2$ filled perforating unit. In one or more embodiments, the individual $CO_2$ filled perforating devices may be detonated at selected times and depths. Upon detonation, perforations may be formed, as shown in FIG. 3, for example, in different formation zones (1, 2, 3). The force of the controlled jet stream expulsion may provide for perforations (4, 5, 6) of one or more formation zones at selected depths as shown in FIG. 3. In some embodiments, the method may include disposing the perforation tool at a first depth, perforating using a lowermost $CO_2$ filled perforating device (such as formation zone 3), and then moving the perforation tool to a second, higher depth and perforating using a second $CO_2$ filled perforating device (such as formation zone 2).

One or more embodiments of the present disclosure may be directed towards a method for perforating a downhole formation. Such a method may include disposing a well tool in a wellbore where the well tool may include one or more $CO_2$ filled perforating devices as described above and shown in FIG. 1A. The method may be directed toward perforating a wellbore and formation by rapidly heating the carbon dioxide liquid in a well tool vessel via an electrical charge that results in a phase change and produces a high pressure carbon dioxide gas. Such a gas may be discharged via a directional outlet associated with each $CO_2$ filled perforating device to perforate the downhole formation.

According to one or more embodiments, the method may include one or more vessels filled with liquid $CO_2$, where the $CO_2$ may be discharged at specified depths. In embodiments where two or more vessels are attached on a wireline and disposed downhole in a formation, the two or more vessels may be discharged such that the perforation of two or more zones, of differing depth, may be accomplished simultaneously. The method may further include the removal of the one or more vessels after they have been discharged so that the spent liquid $CO_2$ included within the vessels can be refilled at the surface and the vessels can be redeployed on a wireline.

As described above, well tools according to one or more embodiments of the present disclosure may include $CO_2$ filled perforating devices. An example of such an embodiment is provided in FIG. 1A, which shows a schematic of the $CO_2$ filled perforating device. The perforating tool may include several units of similar contents and structures. Each unit may be formed with a high strength reusable alloy steel tube 26 filled with liquid $CO_2$ 25 that may be energized with a small electrical charge. Each unit has a source of electric charge 22, a heat source 24, the tube to contain liquid $CO_2$ 26, a rupture disc (not shown) that will burst upon $CO_2$ expansion, and a discharge head 27 including a plurality of discharge outlets 28.

In one or more embodiments of the present disclosure, perforating methods may include filling the $CO_2$ tube of the perforating device with liquid $CO_2$ at the surface. Upon completion of the filling of the one or more units of the perforating device, the device may be attached to a wireline 30 and delivered downhole, as shown in FIG. 2. After placing/disposing the tool at the desired depth in the wellbore 40 (see FIG. 3), the electric charge heating may be initiated, for example but not limited to, through wire-line communications. The electric charge will heat the liquid $CO_2$ through the installed heater essentially instantaneously. The liquid $CO_2$ volume may expand to up to 6000 times its original volume, for example, due to the energy provided by the heat source 24 as shown in relation to FIG. 1B. This expansion will absorb the heat and will cool off the $CO_2$ while building up a large amount of pressure inside the tube. As a result of pressure build up, the formed $CO_2$ gas may burst a rupture disc and be dispelled through the discharge outlets 28 of the discharge head 27 at a significant pressure that can reach up to 40,000 psia, for example. The rupture discs disposed along discharge head 27 control the extent of the $CO_2$ pressure released from the unit.

In accordance with one or more embodiments of the present disclosure, $CO_2$ may be stored in liquid phase within the perforating device. In order for $CO_2$ to remain in the liquid phase during downhole delivery, the temperature of the liquid $CO_2$ may be maintained at a relatively low temperature, for example, less than 30° C., and at pressures above 1000 psia. Higher temperatures and pressures may also be tolerated during downhole delivery.

To help maintain the $CO_2$ in a dense phase and avoid overpressure or early release due to downhole environmental conditions, in one or more embodiments, the $CO_2$ perforated device may include an insulated tube 26 containing the liquid $CO_2$. Insulation may be disposed, for example, around the liquid filled tube 26. In some embodiments, liquid filled tube 26 may be a vacuum insulated tubing (VIT) 29 (FIG. 1C), providing the insulation to maintain the $CO_2$ at a low temperature. A multilayer VIT can yield a significantly low heat loss for several hours or more depending on insulation thickness, $CO_2$ pressure, temperature difference, type of insulation material, and which may be selectively configured to match the requirements of the specific wellbore depth and environment.

FIGS. 2 and 3 show schematics of a perforating system in accordance with one or more embodiments of the present disclosure, in which the above-described perforating methods and devices may be used. In such embodiments, a wellbore hole has been drilled and/or cased from the surface down through subterranean formation zones which may have differing material characteristics. Each of the one or more formation zones may contain hydrocarbon formation fluids, namely oil and/or gas. In one or more embodiments, the differing formation zones may be formed of material with varying characteristics that may require more or less pressure to perforate. A generally cylindrical casing may line the wall of the borehole, defining the wellbore. Cement may be disposed between the wellbore casing and the one or more formation zones.

A perforating unit as described above may be lowered into the wellbore 40 on a wireline tool 30 as shown in FIG. 2. The perforating device may include at least one, and usually several perforating units or vessels. Each unit or vessel includes an electrical charge source, a heating source, liquid $CO_2$, and discharge heads as described above.

As shown in FIG. 3, the $CO_2$ filled perforating devices may be positioned within the wellbore, on the wireline 30. The discharge heads 27 may be disposed within the wellbore such that the discharge outlets 28 are oriented in a manner that, when detonated, produce a jet stream of expanded gas that will be primarily directed outward toward the casing 42, cement 44, and/or one or more formation zones. In one or more embodiments, detonation may be triggered by a signal delivered through a control line from the surface to the electric charge source of the well tool positioned in the wellbore.

The angle of incidence may be measured between the well tool device, and a direction that is normal to an inner surface of the downhole casing at a point where the trajectory intersects the inner surface of the downhole casing. When the discharged gas jet stream contacts the surface at an angle of incidence that is outside the preferred angle of contact, the discharged gas stream may not penetrate and/or ricochet from, the surface.

If not controlled properly, the generated pressure of the $CO_2$ expansion may impair the casing integrity as a whole instead of only creating the desired holes, and the generated $CO_2$ gas jet stream may transmit elsewhere affecting other nearby components and/or tools in the wellbore such, as the wire-line or packers.

As such, in one or more embodiments, the well tool, or $CO_2$ filled perforating device, may be positioned within the wellbore such that the discharge outlets would be proximal to the target surface to be perforated. To position the perforating device of the present disclosure, a stabilizer or stabilizing method may be incorporated. Examples of the stabilizer may include packer elements, extendable arms, sealing devices, and any other mechanisms suitable for stabilizing the perforating device within the wellbore. Such a mechanism may be used to mitigate issues related to impact occurrence, such as may result from the initial discharge of $CO_2$ when detonated. For example, when one discharge port is provided, the stabilizing mechanism may prevent radial movement of the perforating device within the wellbore when detonated. Further, one skilled in the art may appreciate that burst discs, while rated to burst at a given pressure, may not all burst exactly at the same pressure (manufacturing tolerances, defects, etc.); when two or more discharge ports are provided, the stabilizers may prevent unwanted movement of the tool, for example, that may otherwise result from a prematurely bursting disc or a misalignment of ports. Stabilizing modifications may also be incorporated such that an operator does not risk damage to the wellbore or casing as the perforating tool is transported downhole to where it will be used. Accordingly, such stabilizing and/or expansion devices may be incorporated into $CO_2$ filled perforating device/well tools.

Extendable arms may also be used to place the discharge heads 27 in proximity to the casing and/or wellbore. For example, as illustrated in FIG. 3, there is a distance between the $CO_2$ filled perforating devices and the inner wall of the wellbore. The gas jet emanating from the discharge heads 27, as one skilled in the art would recognize, will expand as the jet traverses toward the inner wall of the wellbore or casing, and may thus have a decreased force of impact. A tool according to embodiments herein may include, for example, three or four $CO_2$ filled perforating devices disposed in parallel and connected via a central expandable tool. The arms of the central tool may be contracted during transport, and then may be extended such that the $CO_2$ filled perforating devices are in closer proximity to the wellbore or casing, thus allowing a greater force from the initial discharge to impact the casing or wellbore.

Stabilizers or packer elements may be initiated or engaged by a variety of means including common packing techniques associated with the packer elements, electrical signal, hydraulic signal, optical signal, and any other suitable signal that may be known in the art. Modified well tools in accordance with one or more embodiments of the present disclosure may include such stabilizer or packer elements to provide more precise and controllable means of positions the well tool within the wellbore, as defined by the casing of the well, or within a formation. In one or more embodiments, packer elements may be positioned within the wellbore adjacent to the $CO_2$ filled perforating devices to stabilize the device within the wellbore. In one or more embodiments, the packer elements may be positioned proximally above and/or below the $CO_2$ filled perforating devices to stabilize the device within the wellbore.

In yet other aspects, embodiments disclosed herein may include one or more sealing mechanisms. For example, a sealing mechanism, such as packer elements, may be provided above and/or below the discharge outlets, thereby focusing the increased $CO_2$ pressure within a confined zone of the wellbore, allowing the expanding $CO_2$ to perforate the wellbore while limiting pressure losses axially/vertically within the wellbore.

In some embodiments, the rupture disc may be in the form of a projectile, or may be placed proximal to a projectile, such that when the rupture disc bursts, the rupture disc may be propelled through the discharge port by the high pressure $CO_2$ gas jet stream. Such embodiments may be particularly useful when perforation through casing or particularly hard formation is necessary.

As described above, embodiments detailed herein provide methods and systems for perforating a wellbore and/or formation that do not require the use of explosives and that are environmentally friendly. The safe, consistent, and reusable tool permits numerous advantages over conventional explosive perforating techniques, as noted throughout the description above.

Although the preceding description has been made herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method for perforating a downhole formation comprising:

attaching a $CO_2$ perforating device to a wireline, wherein the $CO_2$ perforating device consists of an electrical charge and one or more insulated $CO_2$ liquid filled perforating units, and the one or more insulated $CO_2$ liquid filled perforating units each comprise a body section and one or more burst discs along the body section, wherein the one or more burst discs are configured to burst in a burst pressure range of 30,000 psia to 40,000 psia;

disposing the $CO_2$ perforating device at a depth within a wellbore while maintaining the $CO_2$ liquid, as a liquid, at a temperature of less than 30° C.; and detonating the one or more insulated $CO_2$ liquid filled perforating units via heating of the $CO_2$ liquid with the electrical charge to the burst pressure of the burst discs to perforate one or more surfaces selected from the group consisting of the wellbore casing, cement, and the downhole formation.

2. The method of claim 1, further comprising stabilizing a position of the $CO_2$ perforating device within the wellbore.

3. The method of claim 1, further comprising radially positioning the one or more insulated $CO_2$ liquid filled perforating units within the wellbore.

4. The method of claim 1, wherein two or more insulated $CO_2$ liquid filled perforating units are detonated simultaneously.

5. The method of claim 1, wherein the $CO_2$ perforating device comprises two or more insulated $CO_2$ liquid filled perforating units, the method further comprising configuring the two or more insulated $CO_2$ liquid filled perforating units to discharge at different perforating pressures.

6. The method of claim 1, wherein the $CO_2$ perforating device comprises two or more insulated $CO_2$ liquid filled perforating units, the method further comprising detonating the two or more insulated $CO_2$ liquid filled perforating units at different times and at different depths.

7. The method of claim 1, further comprising, after detonation of the $CO_2$ perforating device, retrieving the $CO_2$ perforating device from the wellbore, replacing one or more burst discs associated with each of the one or more insulated $CO_2$ liquid filled perforating units, refilling each of the one or more insulated $CO_2$ liquid filled perforating units with liquid $CO_2$ such that the $CO_2$ perforating device can be used in a subsequent perforation operation.

8. A method for perforating a downhole formation, comprising:

disposing a well tool in a wellbore, the well tool consisting of an electrical charge and one or more insulated vessels filled with carbon dioxide liquid, while maintaining the carbon dioxide liquid, as a liquid, at a temperature of less than 30° C.;

heating the carbon dioxide liquid via the electrical charge within the one or more insulated vessels to form high pressure carbon dioxide having a burst pressure in a range of 30,000 psia to 40,000 psia;

rupturing burst discs that are configured to burst with the high pressure carbon dioxide; and after the rupturing ruptures the burst discs, discharging the high pressure carbon dioxide via one or more directional outlets associated with each of the one or more insulated vessels to perforate the downhole formation.

9. The method of claim 8, wherein the well tool comprises two or more insulated vessels, the method comprising:

disposing the well tool at first depth within the wellbore and heating and discharging a first of the two or more insulated vessels;

disposing the well tool at a second depth within the wellbore and heating and discharging a second of the two or more insulated vessels.

10. The method of claim 8, further comprising stabilizing a position of the well tool within the wellbore.

11. The method of claim 8, further comprising radially positioning the one or more insulated vessels within the wellbore.

12. The method of claim 8, wherein disposing the well tool in the wellbore comprises:

disposing the well tool at a desired depth within the wellbore;

stabilizing a position of the well tool within the wellbore; and radially positioning the one or more vessels within the wellbore proximate to an internal surface of the wellbore.

13. A system for perforating a downhole formation, comprising:

a well tool disposed on a wireline, the well tool consisting of:

one or more insulated vessels filled with carbon dioxide liquid;

one or more directional outlets associated with each of the one or more insulated vessels;

an electrical charge generation device configured to heat the carbon dioxide liquid to form a high pressure carbon dioxide having a burst pressure in a range of 30,000 psia to 40,000 psia;

one or more burst discs associated with each of the one or more insulated vessels configured to rupture at the burst pressure in the range of 30,000 psia to 40,000 psia and discharge the high pressure carbon dioxide through the one or more directional outlets; and an actuation mechanism configured to activate the electrical charge generation device, wherein the well tool disposed on the wireline is disposed in a wellbore while maintaining the carbon dioxide liquid, as a liquid, at a temperature of less than 30° C.

14. The system of claim 13, wherein when the system comprises two or more vessels, the two or more vessels are disposed in series relative to one another, wherein the bottom of a first vessel is positioned above the top of a subsequent additional vessel.

15. The system of claim 13, wherein the system comprises two or more vessels disposed in parallel, configured to perforate at a same depth.

16. The system of claim 13, wherein the system comprises vessels arranged in series and in parallel, where two or more vessels are configured to perforate at a same depth and two or more vessels are configured to perforate at a different depth.

17. The system of claim 13, further comprising a packing element to control a position of the well tool within a wellbore.

18. The system of claim 13, further comprising a positioning member configured to radially adjust a position of the one or more vessels.

19. The system of claim 13, wherein the system comprises two or more vessels, and wherein the two or more vessels are configured to discharge high pressure carbon dioxide at different pressures.

20. The system of claim 13, wherein the one or more vessels filled with carbon dioxide are vacuum insulated vessels.

* * * * *